US005606721A

United States Patent [19]

Thayer et al.

[11] Patent Number: 5,606,721

[45] Date of Patent: Feb. 25, 1997

[54] DIAGNOSTIC PROCEDURE TO IDENTIFY CLEANER RETRACTION TIMING FAULTS

[75] Inventors: Bruce E. Thayer; Dennis G. Gerbasi, both of Webster, N.Y.

[73] Assignee: Xerox Corporation, Stamford, Conn.

[21] Appl. No.: 648,467

[22] Filed: May 15, 1996

[51] Int. Cl.[6] ..... G03G 21/00

[52] U.S. Cl. ..... 399/34

[58] Field of Search ..... 355/296, 203–205, 355/207, 299, 208; 430/125; 118/652; 346/33 MC

[56] References Cited

U.S. PATENT DOCUMENTS 4,977,437 12/1990 Asai eat al. ..... 355/27

*Primary Examiner*—Joan H. Pendegrass
*Assistant Examiner*—Quana Grainger
*Attorney, Agent, or Firm*—T. L. Fair

[57] ABSTRACT

A method and an apparatus for identifying cleaner retraction timing faults in an electrostatographic printer. A toner image or patch is developed on the photoreceptor during the non-printing mode of the printer. After cleaning by a retractable cleaner, the portion of the image or patch not cleaned is measured and compared to a predetermined length in order to determine cleaner retracting timing faults in the cleaner subsystem.

9 Claims, 5 Drawing Sheets

DIAGNOSTIC PROCEDURE TO IDENTIFY CLEANER RETRACTION TIMING FAULTS

BACKGROUND OF THE INVENTION

This invention relates to an electrostatographic printer or copier, and more particularly concerns a diagnostic procedure to identify cleaner retraction timing faults.

Cleaning systems consist in large part of two general types of cleaners. For low volume applications, blade cleaners are frequently used due to their low cost. For high volume applications, brush cleaners, either mechanical or biased electrostatic, are frequently used due to their reliability and life. In multi-pass color xerographic systems, retraction of these cleaners, from the photoreceptor, is required while the color images are being developed.

These cleaners (e.g. brushes and blades) rely on mechanical mechanisms such as cams, linkages or slides to move the cleaning elements into and out of contact with the photoreceptor. The operating force for these mechanisms is normally supplied by electric motors and gear trains or is solenoids. These mechanisms or devices can fail due to breakage or binding causing the cleaning elements to remain in either a retracted or engaged position until repaired. The failure of these mechanisms can also cause the speed of the retraction and engagement motions to be reduced as a result of added frictional drag in the bearings, sliders, cams or seals due to contamination by toner, dirt or other debris.

Furthermore, contamination can cause a change in the actuation speed generated by the electromechanical drive components. An example of this change in actuation speed, includes over heating a solenoid or motor which changes the force or torque output of the device or mechanism. Failures due to reduced actuation speed are more difficult to diagnose than failures that stop the cleaning elements completely.

The following disclosure may be relevant to various aspects of the present invention and may be briefly summarized as follows:

U.S. Pat. No. 4,977,437 to Asai et al. discloses an image recording apparatus for recording an image of an original on a developer sheet with the use of a microcapsule, in which the developer sheet and the microcapsule sheet having a surface coated with immense number of photosensitive and pressure-rupturable microcapsules are subjected to pressure development by a pair of pressurizing rollers. To ensure that the pressure development is performed under the condition where the developer sheet and the microcapsule sheet are superposed one on the other, the nip and retract timings of the pressurizing rollers are determined properly according to the present invention. For example, the developer sheet is conveyed at a speed asynchronous with the microcapsule conveying speed and the conveyance of the developer sheet is stopped after its leading edge is introduced between the rollers held in spaced apart condition. The rollers are brought to the nip position to thereby start the pressure development when the exposure start line on the microcapsule sheet is in alignment with the leading end of the developer sheet. The retract timing is determined, for example, depending upon the size of the developer sheet.

SUMMARY OF INVENTION

Briefly stated, and in accordance with one aspect of the present invention, there is provided a method for removing particles from a surface with a retractable cleaner to determine the engagement and retraction timing of the retractable cleaner, comprising: retracting the retractable cleaner from the surface, having movement, while developing a toner image thereon, having a first measurable length; engaging the retractable cleaner with the surface to remove a first predetermined measurable portion of the first measurable length of the toner image; retracting the retractable cleaner and maintaining the retractable cleaner in a retracted state over a distance equivalent to a second predetermined measurable portion of the first measurable length of the toner image remaining on the surface; re-engaging the retractable cleaner to remove the particles remaining on the surface from a third measurable portion of the first measurable length after passing the distance equivalent to the second predetermined measurable portion; and measuring a second measurable length of the toner image remaining on the surface, the second measurable length comprising the second predetermined measurable portion plus a length of the toner image remaining on the surface that occurs as the retractable cleaner retracts away from and engages with the surface.

Pursuant to another aspect of the present invention, there is provided a method for removing particles from a surface with a retractable cleaner to determine the engagement and retraction timing of the retractable cleaner, comprising: retracting the retractable cleaner from the surface, having movement, while developing a toner image thereon having a first measurable length; maintaining full retraction of the retractable cleaner over a distance equivalent to a first predetermined measurable portion of the first measurable length of the toner image; engaging the retractable cleaner with the surface to remove a second predetermined measurable portion of the first measurable length of the, toner image; retracting the retractable cleaner and maintaining the retractable cleaner in the retracted state over a distance equivalent to a third measurable portion of the toner image remaining on the surface, and measuring a second measurable length of the toner image removed from the surface, the second measurable length comprising the second predetermined measurable portion plus a length of removed toner image from the surface that occurs as the retractable cleaner engages with and retracts from the surface.

Pursuant to another aspect of the present invention, there is provided an apparatus far removing particles from a surface with a retractable cleaner to determine the engagement and retraction timing of the retractable cleaner, comprising: a printing machine having a printing mode and a non-printing mode; the retractable cleaner, for removing particles from the surface, capable of engaging with and retracting from the surface during the non-printing mode of the printing machine; means for developing a toner image having a first measurable length, on the surface, during the non-printing mode of the printing machine: and means for measuring a second measurable length on the surface, the second measurable length being particles remaining after cleaning with the retractable cleaner in the non-printing mode of the printing machine.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 5:
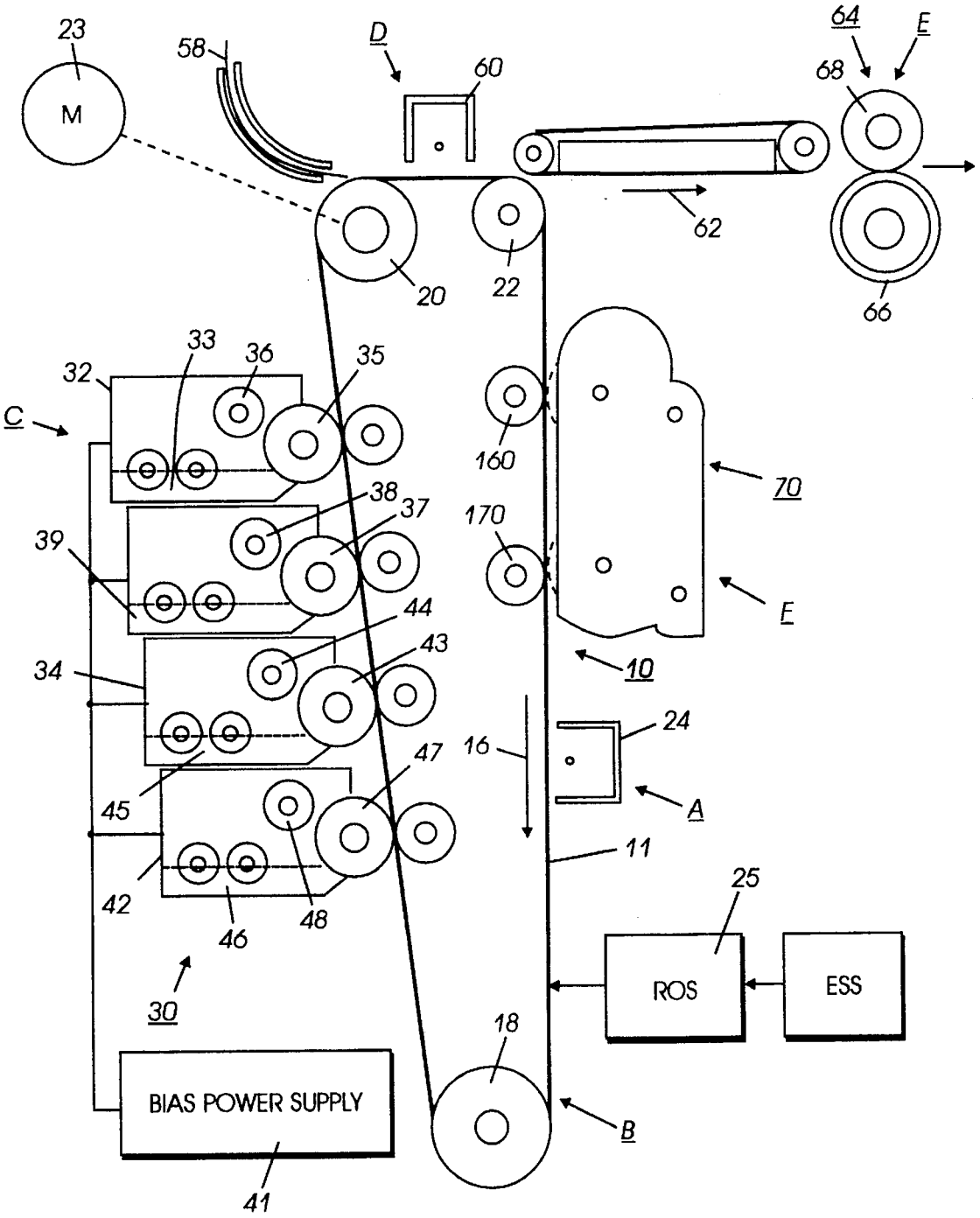
FIG. 5 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 5 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 5, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output: scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B, it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32. 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrcally connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

Figure 1:
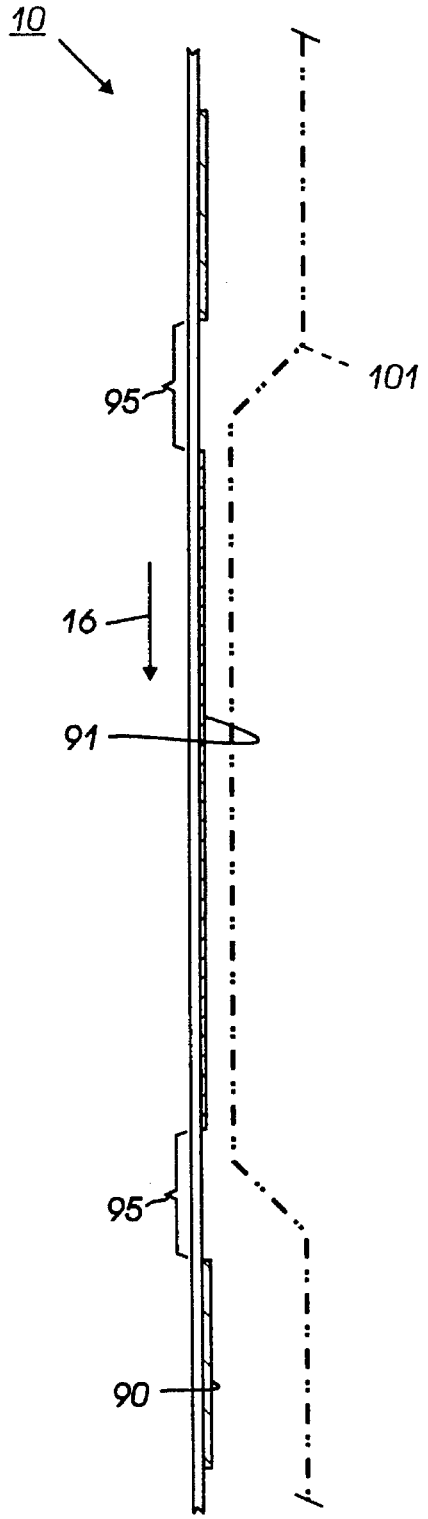
FIG. 1 is a schematic of the retracting and engaging cleaning motion of a cleaner in a multi-pass xerographic system.

Reference is now made to FIG. 1, which shows the retracting and engaging cleaning motion of a cleaner. Multi-pass color xerographic systems require retraction of the cleaner (e.g. brush, blade) from the photoreceptor while the color images are being developed. The dotted line 101 shows the cleaner motion in a multi-pass xerographic system. The dotted line 101 indicates retraction (by the distance away from the photoreceptor 10) of the cleaner over the image area 90 and the engagement of the cleaner with the photoreceptor 10 beginning in the interdocument zone 95 and remaining engaged to clean the residual image particles 91 after transfer of the image. The cleaner then retracts away from the photoreceptor 10 in the interdocument zone 95 as another image 90 is being developed with toner particles. In order to maintain a high level of productivity, the cleaning elements are required to engage and retract from the photoreceptor 10 within the normal interdocument zone 95. Since these interdocument zones 95 are fairly narrow in width, the engagement and retraction of the cleaning elements must occur rapidly and be timed so that all of the residual toner 91 left after transfer is removed and none of the developed image 90 before transfer is removed.

In the present invention, the cleaned length of the developed images are measured to verify the engagement and retraction timing of a retractable cleaner. This method is useful for dual as well as single element cleaners. The diagnostic measurements can be made manually by someone such as a technical representative or automatically by the copy machine through the use of an ESV (i.e., electrostatic voltmeter) or ETAC (i.e., electronic toner area coverage sensor). If the retraction timing is found to be in error, adjustments to the timing can be made either through input from the technical representative or automatically through the machine timing controller.

Reference is now made to FIG. 2, which shows a retraction and engagement cycle time measurement of the present invention. The present invention consists of developing a toner image on the photoreceptor, cleaning a portion of the image with a cleaner which is cycled through the retraction and engagement cycles and then examining the remaining image to determine if the retraction timing was correct. Combinations of several image types and several methods of examining the cleaner image are feasible. Examples of some of these images and methods are provided within this specification. Also, several options are available for use of the timing information once it has been measured.

Figure 2A:
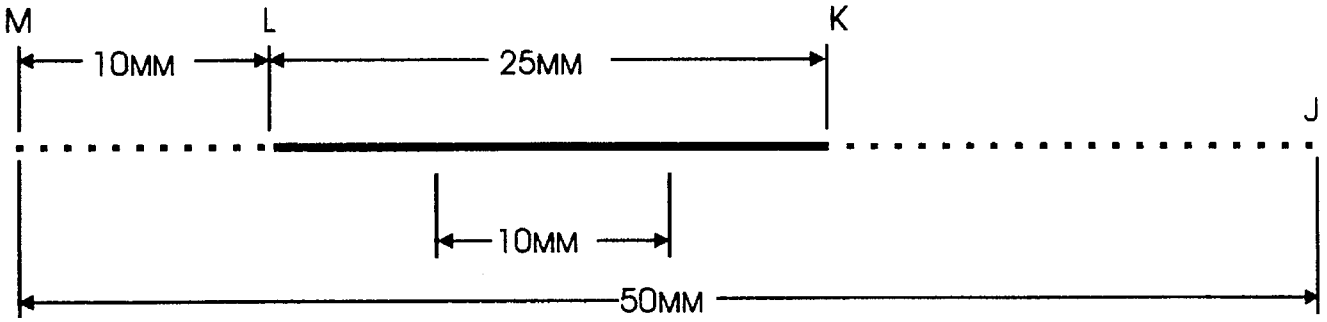
FIG. 2A is a schematic of a retraction and engagement cycle time measurement in the present invention using a line image.
Figure 2B:
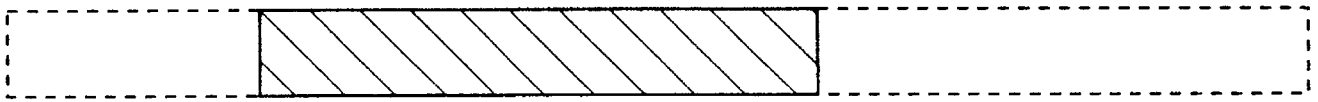
FIG. 2B is a schematic of a retraction and engagement cycle time measurement of the present invention using a band image.

The toner image used must allow the measurement of distance along the photoreceptor in the process direction, which when the process speed is known can be converted to time (distance÷speed=time). The simplest image would be a line in the process direction, as shown in FIG. 2A. As an example to determine if the retraction and engagement timing is working properly, the following test could be run. First, develop a line 50 mm long (i.e. the original length of the developed line 110). Next, engage the cleaning element to clean approximately the first 10 mm of the line. Then, retract the cleaning element. Then, allow the cleaning element to remain retracted for a time equivalent to 10 mm of photoreceptor travel. Next, engage the cleaning element and clean the end of the line. Then, measure the length of the line which was not cleaned. Finally, the length of time required to perform the retraction and engagement cycles is equal to the remaining length of line on the photoreceptor minus the 10 mm when the cleaning element was in the fully retracted position divided by the photoreceptor speed; cycle time= (line length−10 mm)/photoreceptor speed.

Figure 2C:
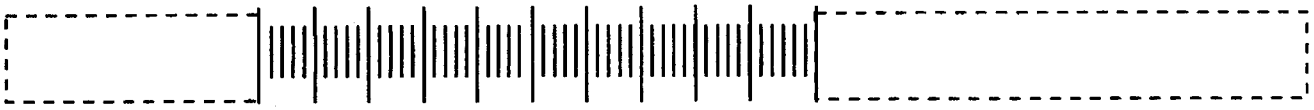
FIG. 2C is a schematic of a retraction and engagement cycle time measurement of the present invention using a stripe image.

Other ways the image could be shown include a band in the process direction (see FIG. 2B) or a series of parallel lines perpendicular to the process direction (see FIG. 2C). The lines of FIG. 2C may be convenient in that counting the number of lines remaining, subtracting the lines passing under the cleaning element during the retracted dwell time and multiplying by the time for the photoreceptor to travel the spacing between the lines yields the cycle time.

If the measurement of the remaining portion of the image is to be made manually (e.g. by a technical representative), then counting lines would perhaps be easier than measuring the length of a band or line. With known dwell time and photoreceptor speeds, the tech rep would compare the number of lines counted to a specification range. The number of lines less than or greater than the specification value could also indicate the change required in timing NVM (i.e., non-volatile memory) parameters. A similar procedure could be followed if the length of a band or line is measured with a ruler.

The length of the remaining portion of the image could also be measured by an ESV, and ETAC or some other type of sensor positioned above the photoreceptor surface. The machine software could compute the value and display the result to the tech rep for corrective action if required. Or, the machine could automatically make the measurement and automatically make any corrections to the cleaner retraction cycle timing in order to operate within specifications. This type of self-correcting measurement and action could be taken at infrequent intervals because of the expected slow changes in retraction performance. This would result in very small impacts on toner consumption and copy productivity.

If only one end of the image is cleaned rather than both ends, then the retraction and engagement times can be determined separately. For example, in FIG. 2A, instead of cleaning the image from J to K and then from L to M, the engagement would start at some predetermined time after the image had passed under the blade and only clean from L to M. The length of the remaining image minus the dwell length before the engagement cycle was started now represents the time for the cleaner to engage and clean the photoreceptor. A similar procedure could be used on the right side of the image in FIG. 2A to determine the amount of time required to retract the cleaner. In both retraction and engagement cases, the length of the image remaining is determined by the cleaner motion speed and the accuracy with which the length of image developed can be coordinated with the retraction or engagement signal to the cleaner. If required the needed accuracy can be obtained by storing a reference image length in the machine memory when this test is performed under known specification conditions such as in final test in manufacturing. Registration requirements for color printing, however, make it likely that the timing of the, cleaner motions to the position of the image under the cleaner can be controlled accurately enough.

Figure 3A:
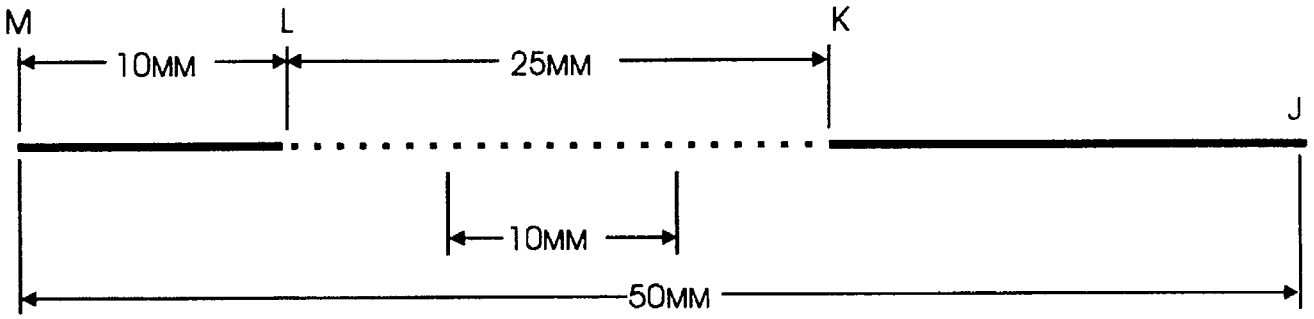
FIGS. 3A–3C show a converse embodiment of the retraction and engagement cycle time measurement by measuring the area cleaned of the: line image (3A), band image (3B), or stripe image (3C).
Figure 3B:
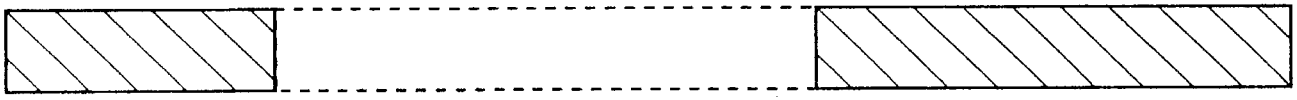
Figure 3C:
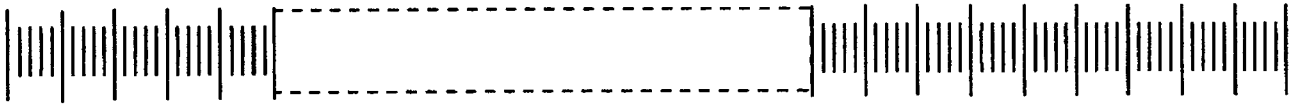

Another embodiment of the present invention is shown in FIGS. 3A–3C. In FIGS. 3A–3C, rather than measuring the length of toner remaining on the photoreceptor as in FIGS. 2A–2C, the length of cleaned area on the photoreceptor is measured using the same process as in FIGS. 2A–2C.

Figure 4A:
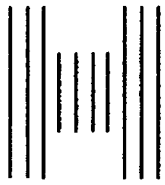
FIGS. 4A–4H are schematic representations of retraction and engagement measurements of developed images before cleaning and after cleaning.
Figure 4B:
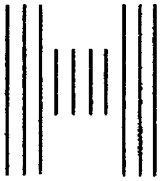
Figure 4C:
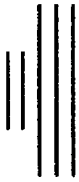
Figure 4D:
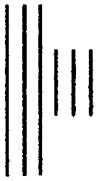
Figure 4E:
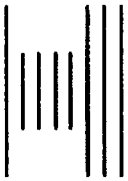
Figure 4F:
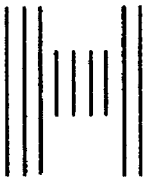
Figure 4G:
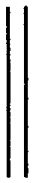
Figure 4H:
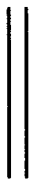

If the image position to cleaner motion start can be controlled accurately, then even simpler measurements can be made. For example, rather than using the long length of the developed image shown in FIGS. 2A–2C, a shod segment of image developed around the engagement and retraction locations on the photoreceptor can be used. An example of this shorter length segment is shown by the series of FIGS. 4A–4H. FIG. 4A shows the engagement target band of lines after developing images before cleaning. FIG. 4B shows the retraction target band before cleaning. When the engagement and retraction of the cleaner is within timing specifications, one set of long lines and one set of short set of lines remains on the photoreceptor after cleaning, as shown in FIGS. 4C and 4D. However, when the mechanisms for retraction and engagement are out of specification, the lines remaining either have two sets of long lines as in FIGS. 4E (i.e. engagement of the cleaner is too late) and 4F (i.e. retraction of the cleaner is too early), or have no short lines remaining as shown in FIG. 4G (i.e. engagement of the cleaner is too early) and 4H (i.e. retraction of the cleaner is too late). As an automatic control method the lines could be counted by a sensor or the distance of a solid band could be measured.

In recapitulation, the present invention discloses an apparatus and a method for diagnosing cleaner retraction timing faults. An example of this diagnostic procedure includes, first, developing a line 50 mm long. Next, engaging the cleaning element to clean approximately the first 10 mm of the line. Then, retracting the cleaning element. Then, allowing the cleaning element to remain retracted for a time equivalent to 10 mm of photoreceptor travel. Next, engaging the cleaning element and cleaning the end of the line. Then, measuring the length of the line which was not cleaned. Finally, the length of time required to perform the retraction and engagement cycles is equal to the remaining length of line on the photoreceptor minus the 10 mm when the cleaning element was stopped in the fully retracted position divided by the photoreceptor speed. (e.g. Where cycle time=(line length−10 mm)/ photoreceptor speed).

It is, therefore, apparent that there has been provided in accordance with the present invention, a diagnostic procedure to identify cleaner retraction timing faults that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for removing particles from a surface with a retractable cleaner to determine the engagement and retraction timing of the retractable cleaner, comprising:

retracting the retractable cleaner from the surface, having movement, while developing a toner image thereon, having a first measurable length;

engaging the retractable cleaner with the surface to remove a first predetermined measurable portion of the first measurable length of the toner image;

retracting the, retractable cleaner and maintaining the retractable cleaner in a retracted state over a distance equivalent to a second predetermined measurable portion of the first measurable length of the toner image remaining on the surface;

re-engaging the retractable cleaner to remove the particles remaining on the surface from a third measurable portion of the first measurable length after passing the distance equivalent to the second predetermined measurable portion; and measuring a second measurable length of the toner image remaining on the surface, the second measurable length comprising the second predetermined measurable portion plus a length of the toner image remaining on the surface that occurs as the retractable cleaner retracts away from and engages with the surface.

2. A method as recited in claim 1, further comprising the step of determining the timing by setting a length of time required to perform retraction and engagement cycles equal to the second measurable length of the toner image on the surface less the second predetermined measurable portion of the toner image on the surface after the retractable cleaner has been fully retracted divided by a speed of the surface.

3. A method for removing particles from a surface with a retractable cleaner to determine the engagement and retraction timing of the retractable cleaner, comprising:

retracting the retractable cleaner from the surface, having movement, while developing a toner image thereon having a first measurable length;

maintaining full retraction of the retractable cleaner over a distance equivalent to a first predetermined measurable portion of the first measurable length of the toner image;

engaging the retractable cleaner with the surface to remove a second predetermined measurable portion of the first measurable length of the toner image;

retracting the retractable cleaner and maintaining the retractable cleaner in the retracted state over a distance equivalent to a third measurable portion of the toner image remaining on the surface; and measuring a second measurable length of the toner image removed from the surface, the second measurable length comprising the second predetermined measurable portion plus a length of removed toner image from the surface that occurs as the retractable cleaner engages with and retracts from the surface.

4. A method as recited in claim 3, further comprising the step of determining the timing by setting a length of time required to perform retraction and engagement cycles equal to the second measurable length of the toner image on the surface less the predetermined measurable portion of the toner image after the retractable cleaner has been fully engaged divided by a speed of the surface.

5. An apparatus for removing particles from a surface with a retractable cleaner to determine the engagement and retraction timing of the retractable cleaner, comprising:

a printing machine having a printing mode and a non-printing mode;

the retractable cleaner, for removing particles from the surface, capable of engaging with and retracting from the surface during the non-printing mode of said printing machine;

means for developing a toner image having a first measurable length, on the surface, during the non-printing mode of said printing machine; and means for measuring a second measurable length on the surface, the second measurable length being particles remaining after cleaning with the retractable cleaner in the non-printing mode of said printing machine.

6. An apparatus as recited in claim 5, wherein said measuring means comprises a measurement sensor.

7. An apparatus as recited in claim 6, wherein said measurement sensor enables calculation of retraction timing of said retractable cleaner by setting a length of time required to perform retraction and engagement cycles equal to the second measurable length of the toner image on the surface less a predetermined measurable portion of the toner image after the retractable cleaner has been fully retracted divided by a speed of the surface.

8. An apparatus as recited in claim 7, wherein the retractable cleaner comprises a brush.

9. An apparatus as recited in claim 7, wherein the retractable cleaner comprises a blade.

* * * * *